US007506598B2

(12) United States Patent
Kimble

(10) Patent No.: US 7,506,598 B2
(45) Date of Patent: Mar. 24, 2009

(54) FITTED DECK FOR BOAT, YACHT OR SHIP

(76) Inventor: Michael Ray Kimble, 2952 Main St., San Diego, CA (US) 92113

( * ) Notice: Subject to any disclaimer, the term of this patent is extended or adjusted under 35 U.S.C. 154(b) by 397 days.

(21) Appl. No.: 11/232,928

(22) Filed: Sep. 22, 2005

(65) Prior Publication Data

US 2007/0062431 A1 Mar. 22, 2007

(51) Int. Cl.
*B63B 3/00* (2006.01)

(52) U.S. Cl. ..... 114/85

(58) Field of Classification Search ..... 114/85
See application file for complete search history.

(56) References Cited

U.S. PATENT DOCUMENTS 3,087,206 A * 4/1963 Delf et al. ..... 52/126.5
3,189,514 A * 6/1965 Shriver et al. ..... 428/457
3,222,030 A * 12/1965 Thorpe ..... 254/100
3,713,264 A * 1/1973 Morgan, Jr. ..... 52/506.06
5,839,239 A * 11/1998 Jang ..... 52/123.1

* cited by examiner

*Primary Examiner*—Stephen Avila
(74) *Attorney, Agent, or Firm*—John R. Ross; John R. Ross, III

(57) ABSTRACT

A fitted deck and a method for installing the fitted deck above an as-built deck of a boat, ship or yacht (sometime referred to hereafter collectively as a vessel). Threaded stud elements are stud welded or glued to the surface of the as-built deck of the vessel to form a regular grid of threaded studs spaced close together (preferably about 1 foot apart). Onto each stud a "leveling plate" is threaded to a specific height preferably indicated by laser level indicator and a set of height specifications determined by a computer processor to achieve for the deck a desired camber, sheer, and slope. Support rails are spot welded to the leveling plates to provide a floor support for the deck. The support rails are preferably aligned in directions generally perpendicular to the vessel axis (i.e., aligned port to starboard). Specially designed batten rail fixtures aligned fore and aft (bow to stern parallel to the axis of the vessel) and are welded to the support rails to form a locking grid to lock in deck batten units. In a preferred embodiment the deck batten units are about 96 mm wide made by gluing a natural wood boards to a composite support to produce battens about 96 mm wide and several meters long. The wood is preferably teak about 12 mm thick and the composite material is reinforced plastic also about 12 mm thick. The composite support includes longitudinal groves on each side to lock the deck batten units into the specially designed batten rail fixtures. Once placed in the fixtures the deck batten units are locked into place with a locking spline which is covered with a narrow rubber-like material. The end result is a beautiful teak deck which is suspended above the as built deck maintaining a perfect camber, sheer, and sloop to assure drainage.

18 Claims, 11 Drawing Sheets

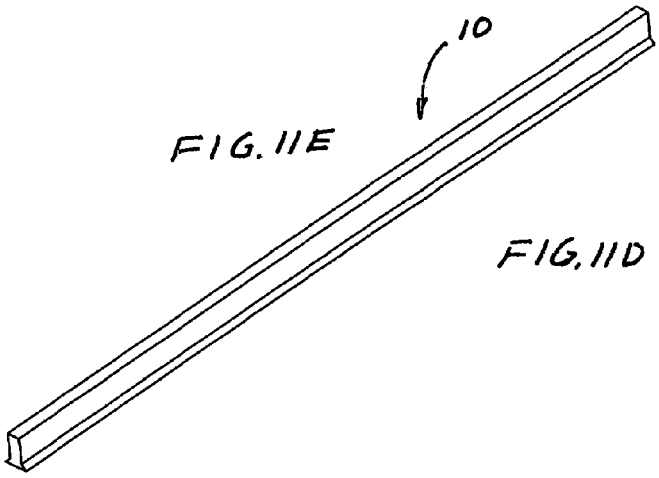
FIG. 11E
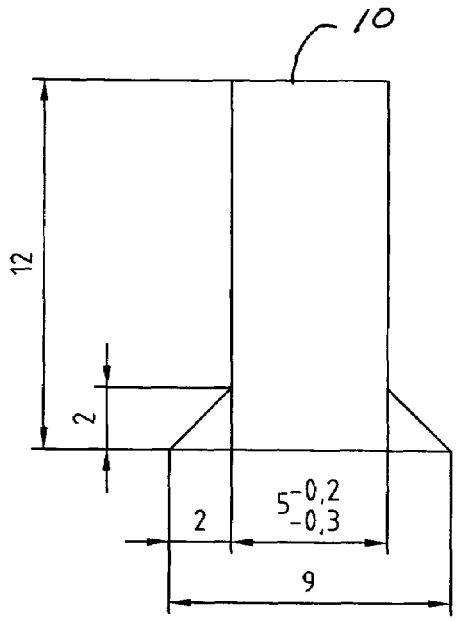
FIG. 11D
FIG. 11F
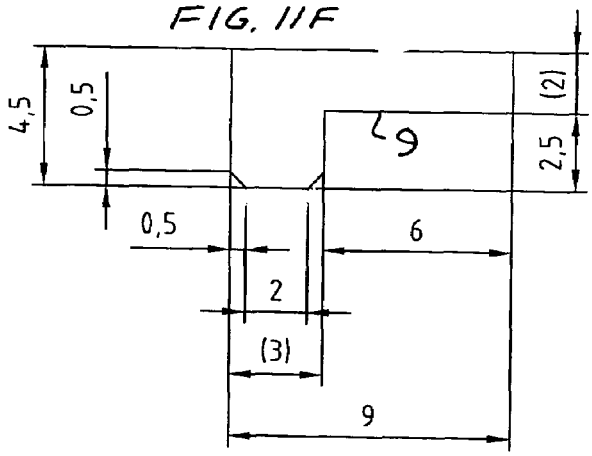
FIG. 11G
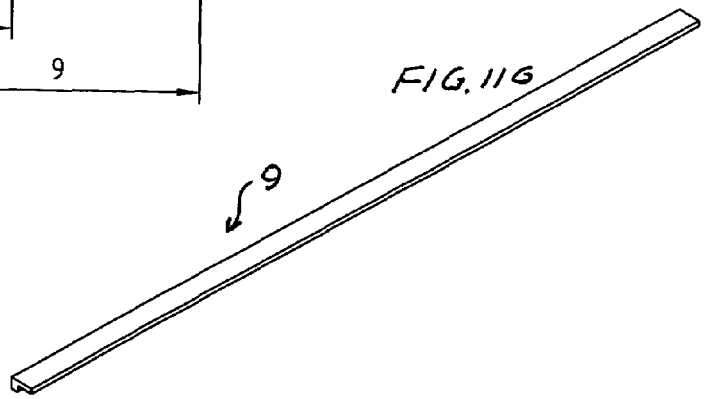

FITTED DECK FOR BOAT, YACHT OR SHIP

The present invention relates to decks and in paticular to wooden decks for boats and Especially teak decks for yachts and ships.

BACKGROUND OF THE INVENTION

The quality of decks for expensive yachts is very important. Typically, the top surfaces of these decks are natural teak wood. In general there have only been a few methods used for installing a "teak deck" or other wooden deck covering to a boat, yacht or ship over the ages. The traditional method used for decades by shipwrights around the world is well known art and involves planking the deck by independently shaping and attaching each individual strip or batten of wood with mechanical fasteners, some type of adhesive or both. A newer method was described in U.S. Pat. No. 4,351,256 filed in February of 1980. It was primarily designed for "production yachts" and involves constructing a teak deck off the boat using a backing material and then taking the teak deck in large panels to the yacht for installation. The installation is again secured with mechanical fasteners, adhesives or both. More recently as teak and other exotic woods increased in price several types of "imitation" teak coverings appeared on the market. These are synthetic materials. The "Shape Conforming Surface Covering" which is described in U.S. Pat. No. 6,895,881 filed in January of 2001 and granted in May of 2005 is one such method.

Some shipboard and yacht interior floors are installed differently than exterior (weather decks). They are "double floored" to provide space under the interior floor to run cables and other system components like floors in large building ashore. These systems like "Free Access Floor and Method of Constructing the Same" described in U.S. Pat. No. 4,922,670 break the floor into grids (squares or rectangles). The method is not usable to install a teak deck on a boat, yacht or ship because wooden decks are run in long individual pieces between 48 MM and 96 MM wide and normally at least 3 meters each in length. Like U.S. Pat. No. 5,899,029, "Support Structure for Floor Plates" they are mentioned only to document the term "double flooring" which is now a common method of describing a floor above a floor.

For the prior art methods for installing a teak deck on a boat, yacht, or ship discussed above (i.e., one individual batten at a time, panel system, and synthetic teak), the procedure begins with the existing structure or skin of the ship which can be described as the "as-built deck". As-built decks are normally made of the same material as the ship; i.e., steel, aluminum, fiberglass, epoxy, or wood. Regardless of the material, the as-built deck is almost always uneven and unprotected. Prior to covering it with wood or imitation wood, the as-built deck must first be cleaned and protected with some kind of coating or primer to protect it from corrosion or other damage. Following the primer coat (or coats) these uneven decks must be filled with a fairing compound to make them smooth and to make them conform to a desired "camber", "sheer", and or "slope". This will ensure water drains from the finished deck to the desired drain locations. Depending upon the fairness of the original construction, this fairing may take many layers. This deck fairing always takes considerable time, money, and adds significant weight to the boat, yacht or ship. Proper fairing of the as-built deck is critical to ensure the final covering of wood or imitation wood is smooth and that water is drained from the boat, yacht or ship.

Once the as built deck has been faired to the desired lines and smoothness the final wood or imitation wood covering is attached to the now primed and faired as built deck to make the "deck". Attachment techniques include mechanical fastening (with screws, bolts, or studs) or some type of adhesive (glue) or both mechanical fasteners and adhesives. The goal is to provide a long-term bond between the wood or imitation wood deck and the faired "as built" deck below. For some projects the entire faired as-built deck is covered with plywood to provide cleat stock and a more suitable gluing surface. This procedure, normally called "sub-decking" adds more money and weight to the project.

Regardless of the method used, the desired goal of the current art is to provide a permanent watertight seal between the top layer and all the multiple layers below. However, it is well known that most teak decks are replaced well before the teak wears out. This is distressing since teakwood is in very short supply. The need to replace the teak deck is usually due to the early failure of one of the many adhesives or mechanical fastening systems used to supposedly permanently fix the system to the faired as-built deck. This can be from improper selection of adhesives; improper application of adhesives or more likely due to water penetrating from the top surface of the deck into one of the many joints below. Any leakage of water from the top surface of a teak deck installed using the described installation methods is normally trapped somewhere in the underlying structure. Since "trapped fluid" normally can not escape and because fluid is not readily compressible it is the cause of most teak deck failures. Water trapped in a space in the deck can act as a hydraulic fluid when someone steps on the deck above the space and the water forces outward creating a larger space in the underlying deck. This larger space can now accept more water and the process continues and corrosion begins, epoxies fail, fasteners release and the teak fails. When failure of a teak deck occurs for any reason in any percentage of the covered surface, the repair cost normally exceeds the original installation cost because of the destructive procedures required to "rip out" the failed sections.

What is needed is a better deck for boats, yachts and ships.

SUMMARY OF THE INVENTION

The present invention provides a fitted deck and a method for installing the fitted deck above an as-built deck of a boat, ship or yacht (sometime referred to hereafter collectively as a vessel). Threaded stud elements are stud welded or glued to the surface of the as-built deck of the vessel to form a regular grid of threaded studs spaced close together (preferably about 1 foot apart). Onto each stud a "leveling plate" is threaded to a specific height preferably indicated by laser level indicator and a set of height specifications determined by a computer processor to achieve for the deck a desired camber, sheer, and slope. Support rails are spot welded to the leveling plates to provide a floor support for the deck. The support rails are preferably aligned in directions generally perpendicular to the vessel axis (i.e., aligned port to starboard). Specially designed batten rail fixtures aligned fore and aft (bow to stern) parallel to the axis of the vessel) and are welded to the support rails to form a locking grid to lock in deck batten units. In a preferred embodiment the deck batten units are about 96 mm wide made by gluing a natural wood boards to a composite support to produce battens about 96 mm wide and several meters long. The wood is preferably teak about 12 mm thick and the composite material is preferably reinforced plastic also about 12 mm thick. The composite support includes longitudinal groves on each side to lock the deck batten units into the specially designed batten rail fixtures. Once placed in the fixtures the deck batten units are locked into place with a locking spline which is covered with a narrow rubber-like material. The end result is a beautiful teak deck which is suspended above the as built deck maintaining a near perfect camber, sheer, and sloop to assure drainage. Should minor amounts of water get through the batten structure it is simply drained from the air space below to drains in the as-built deck. When a batten is damaged or if deck modifications are required it is simple to remove the narrow rubber seam covering the locking spline. Once the locking splines are removed battens can be taken from their fixtures and repaired or replaced at relatively minimal cost. The present invention eliminates the need for fairing of the as built deck as well as any need for plywood sub-decking over the fairing of as built decks.

FIB. 3 is an exploded isometric overview of the substructure.

Figure 4:
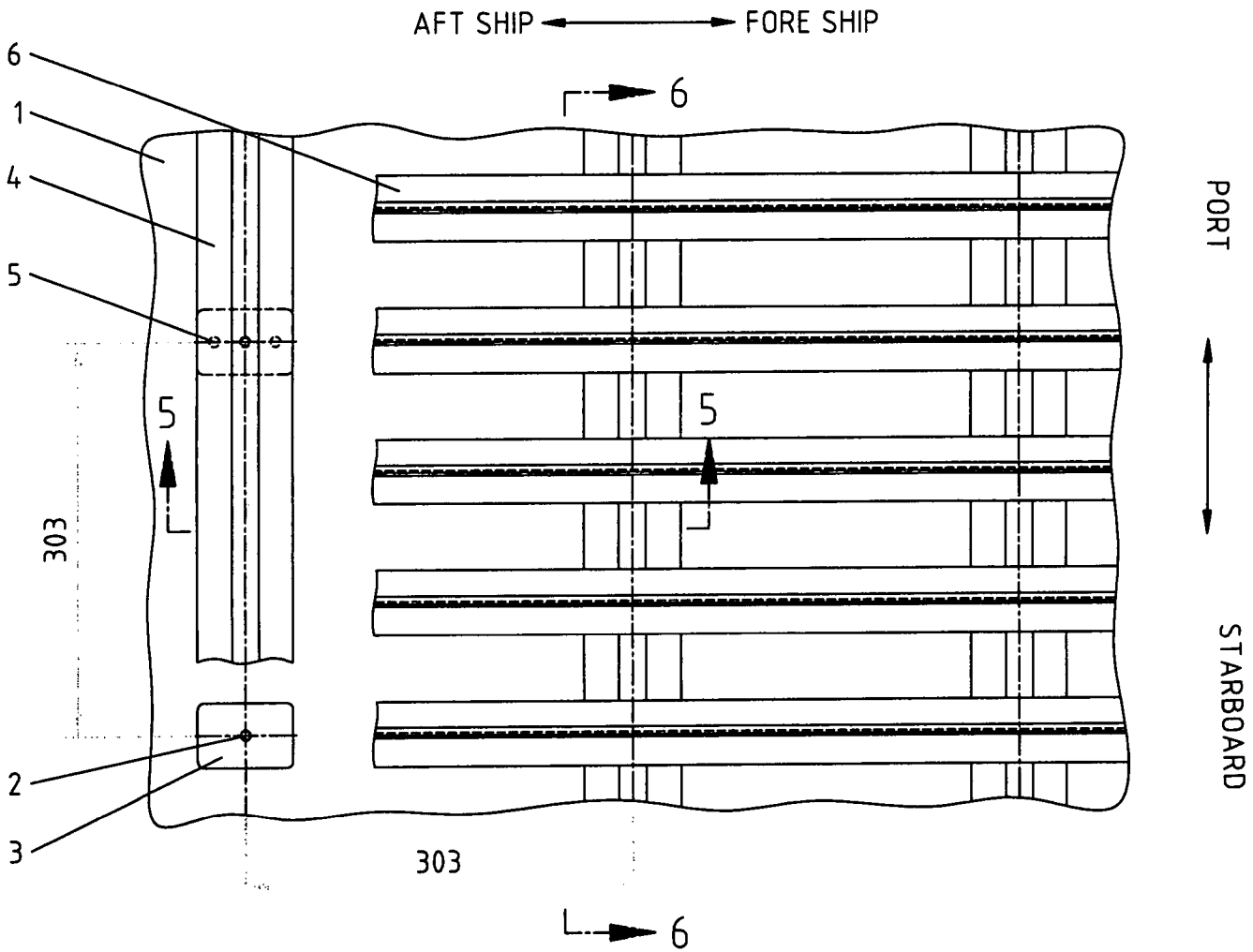

FIG. 4 is a top view of the substructure.

Figure 5:
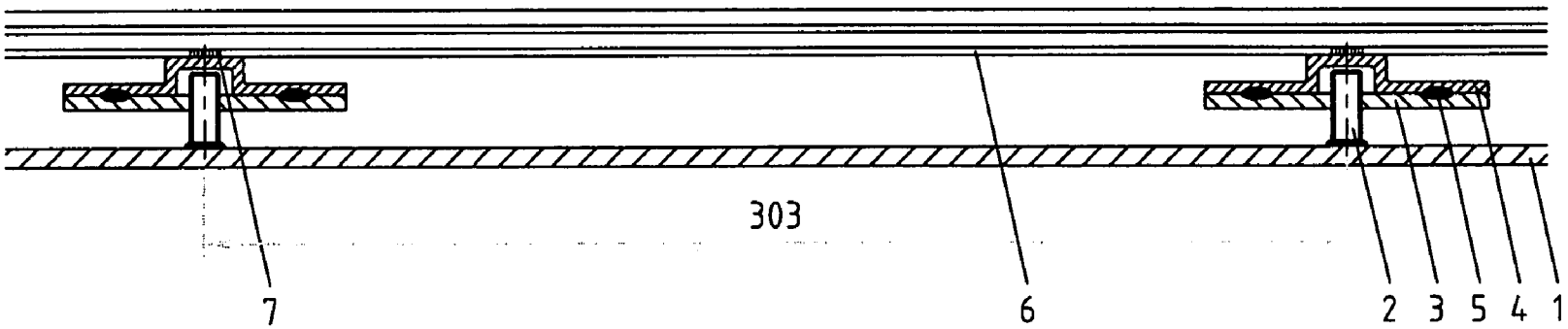

FIG. 5 is a longitudinal cross-section of the substructure.

Figure 6:
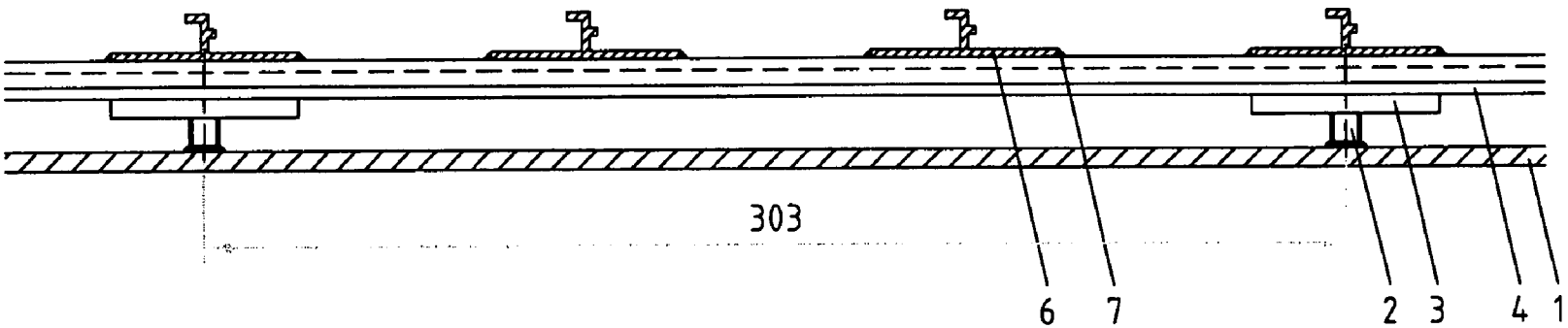

FIG. 6 is a transverse cross-section of the substructure.

Figure 7:
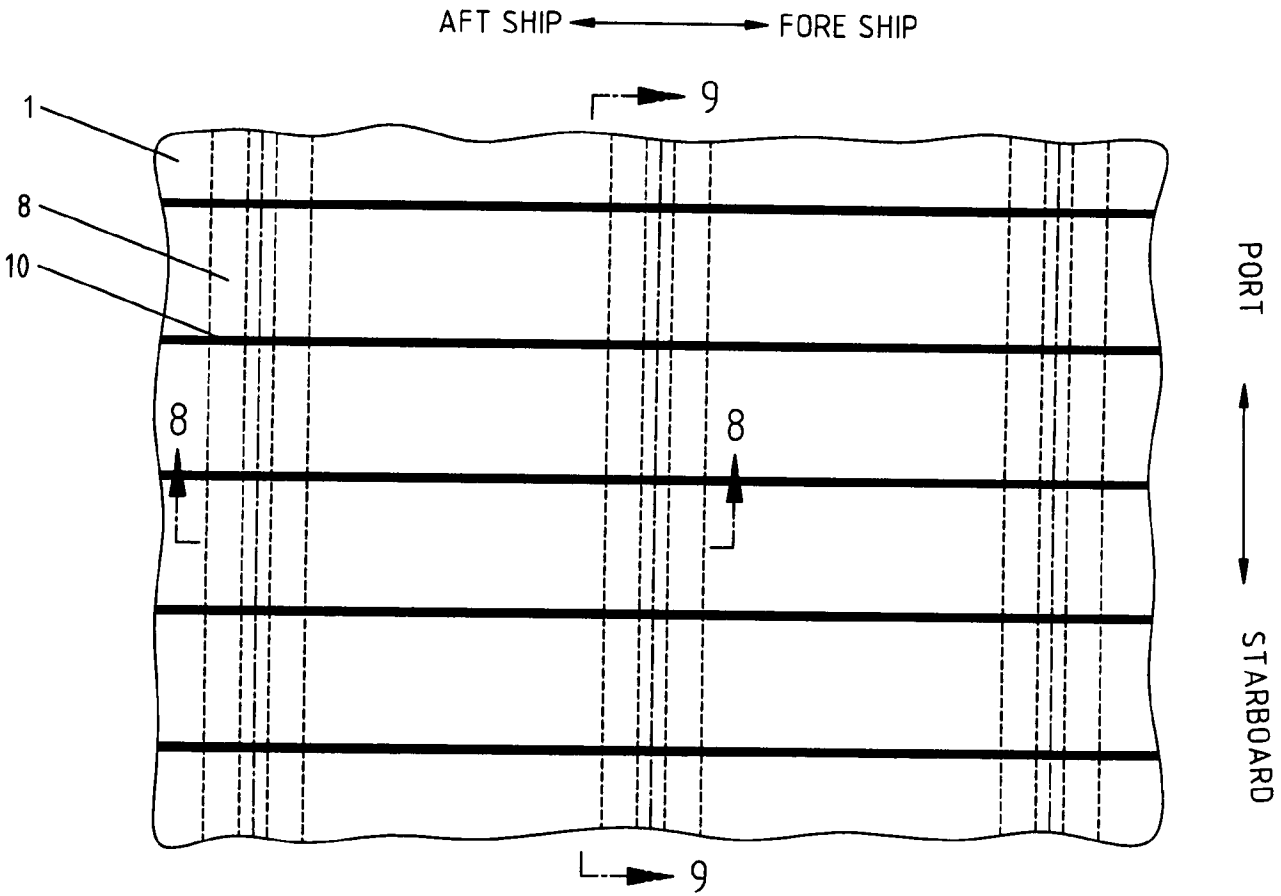

FIG. 7 is a top view of the elevated teak deck.

Figure 8:
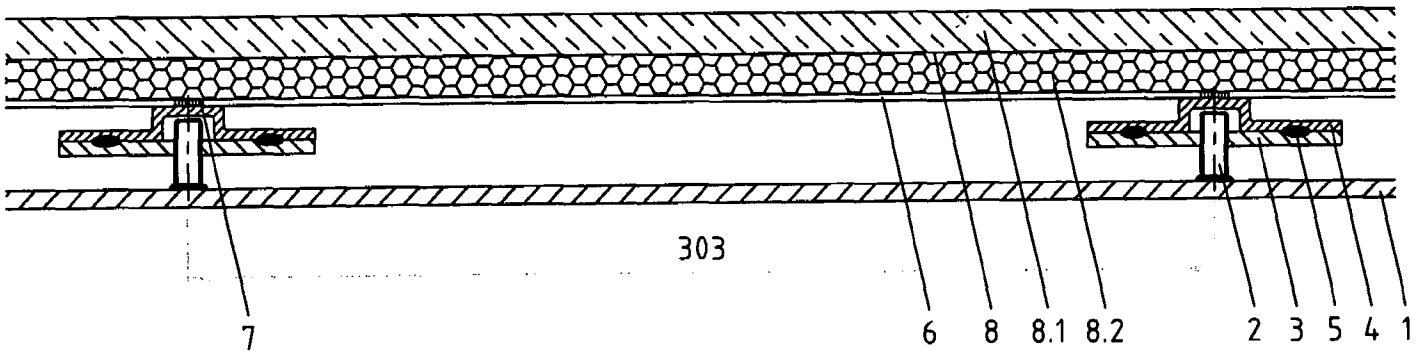

FIG. 8 is a longitudinal cross-section of the elevated teak deck.

Figure 9:
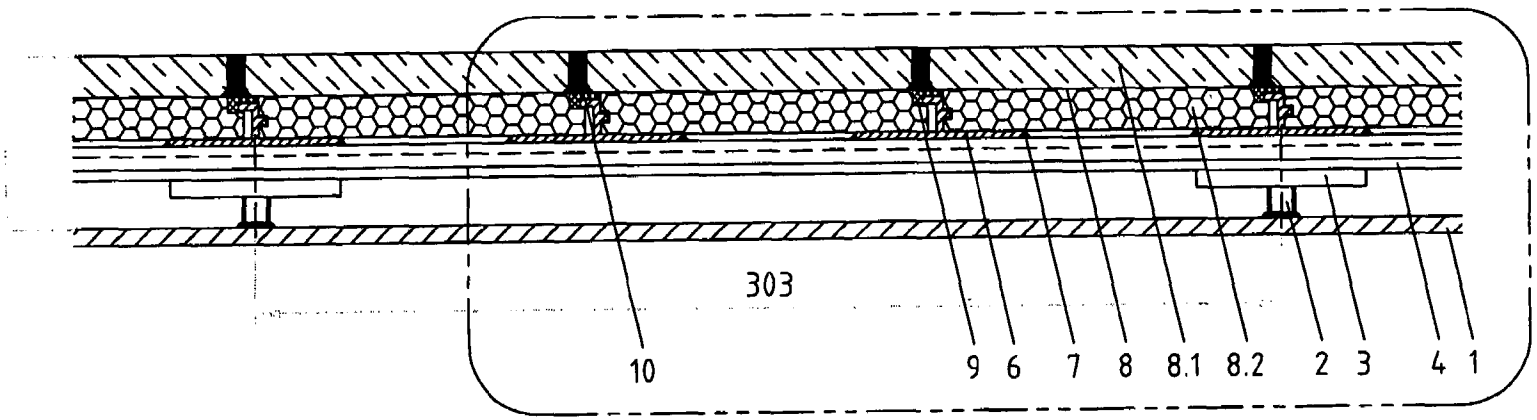

FIG. 9 is a transverse cross-section of the elevated teak deck.

Figure 10:
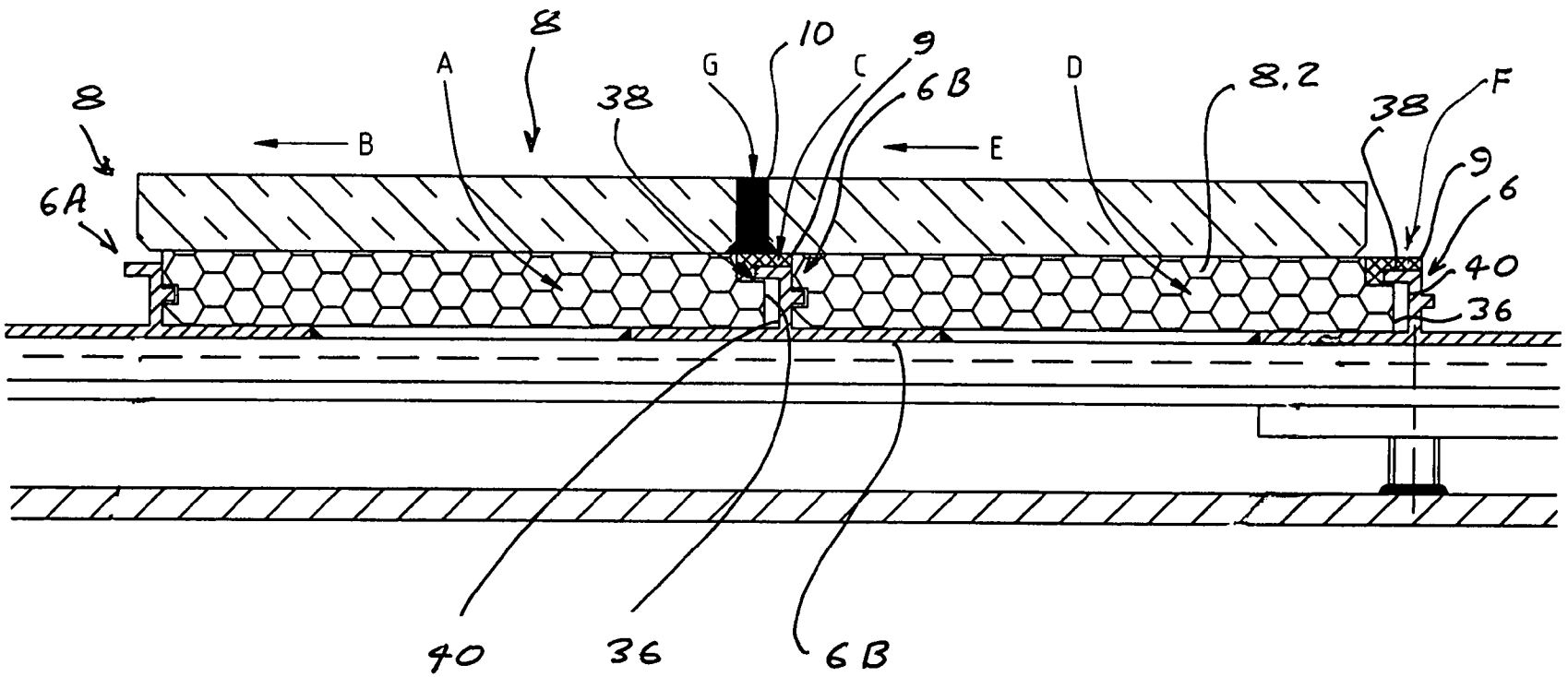

FIG. 10 is an assembly sequence of teak composites.

Figure 11A:
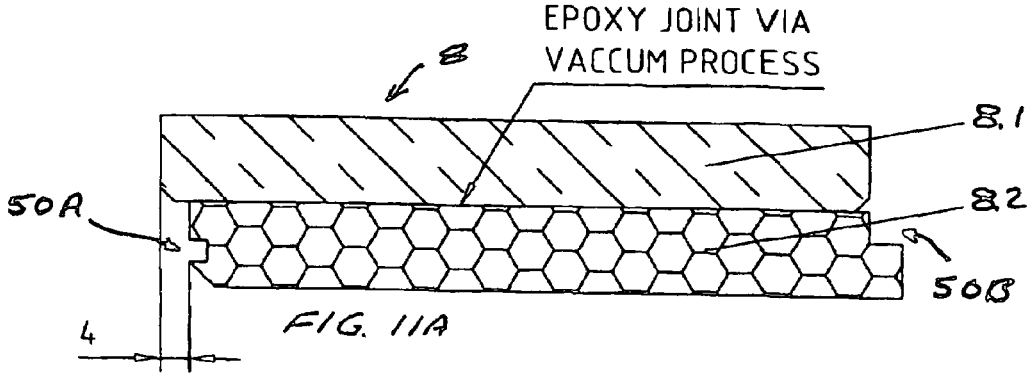
Figure 11B:
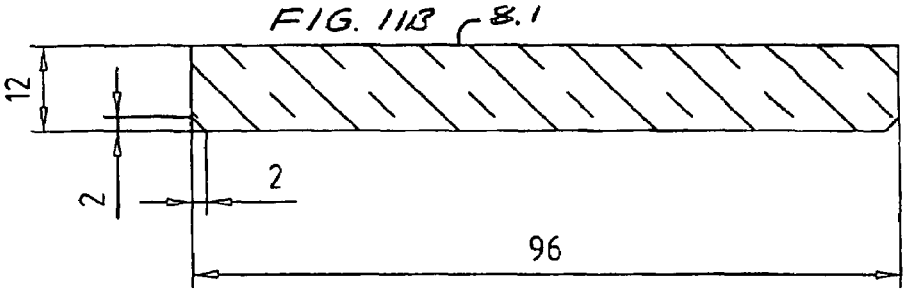
Figure 11C:
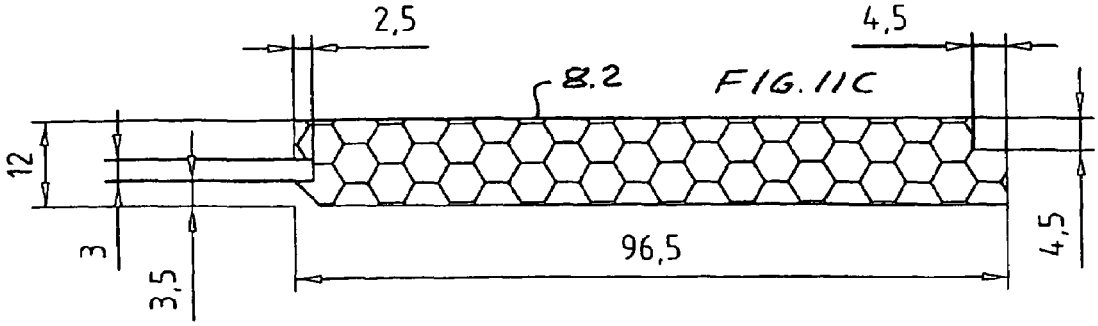
Figure 11H:
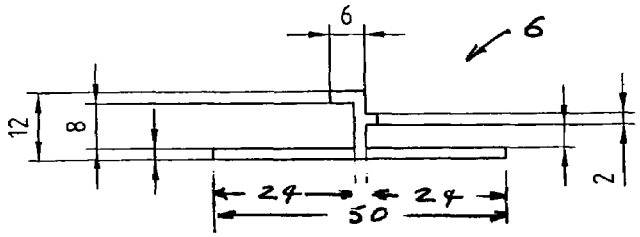
Figure 11I:
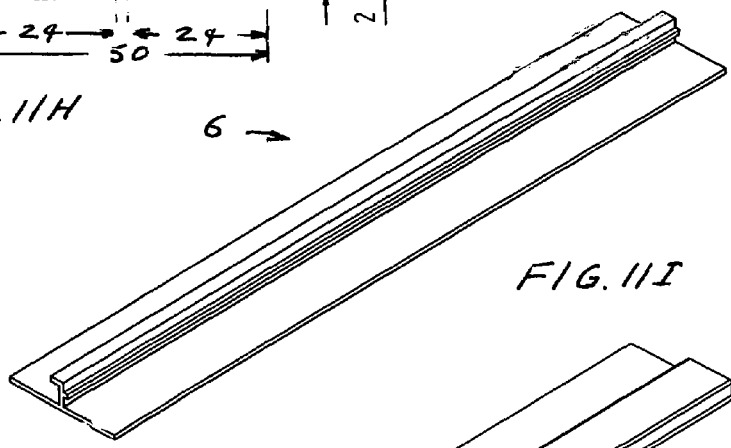
Figure 11K:
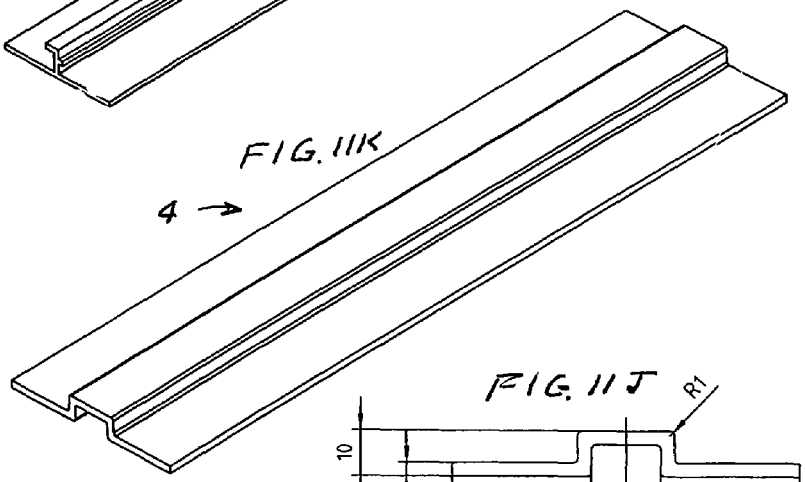
Figure 11J:
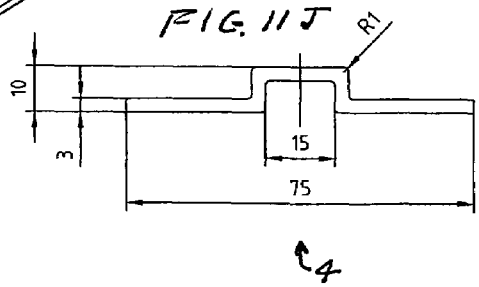
Figure 11L:
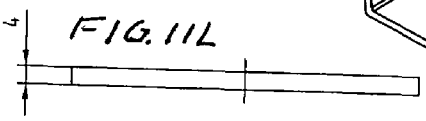
Figure 11M:
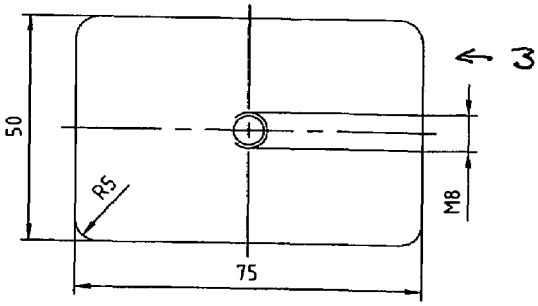
Figure 11N:
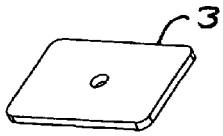

FIGS. 11A through 11N are detailed drawings of individual components of a preferred embodiment of the present invention.

DETAILED DESCRIPTION OF PREFERRED EMBODIMENTS

First Preferred Embodiment

Teak Deck for As-Built Steel Deck

Figure 1:
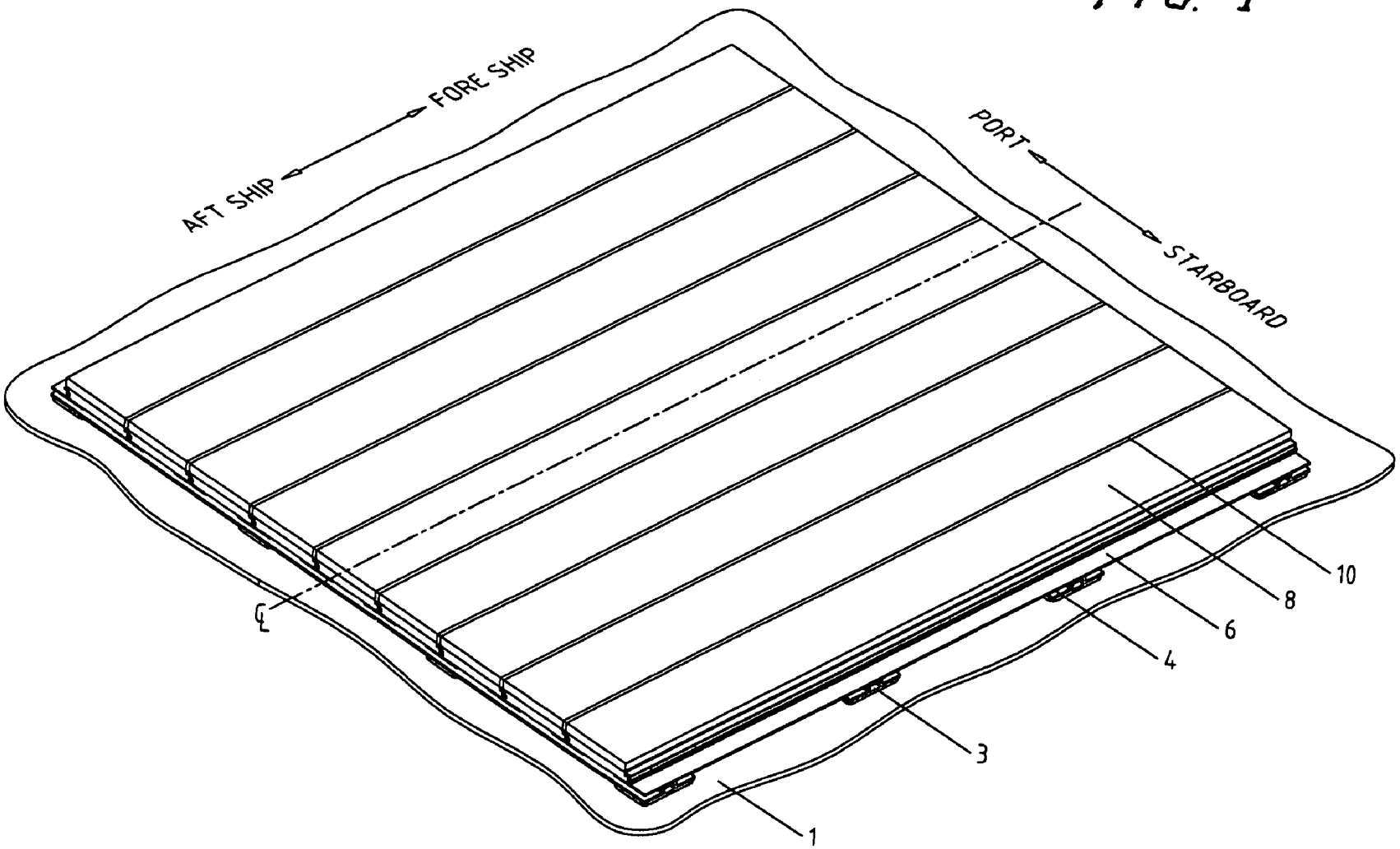
FIG. 1 is an isometric overview of approximately one square meter of elevated teak deck.
Figure 2:
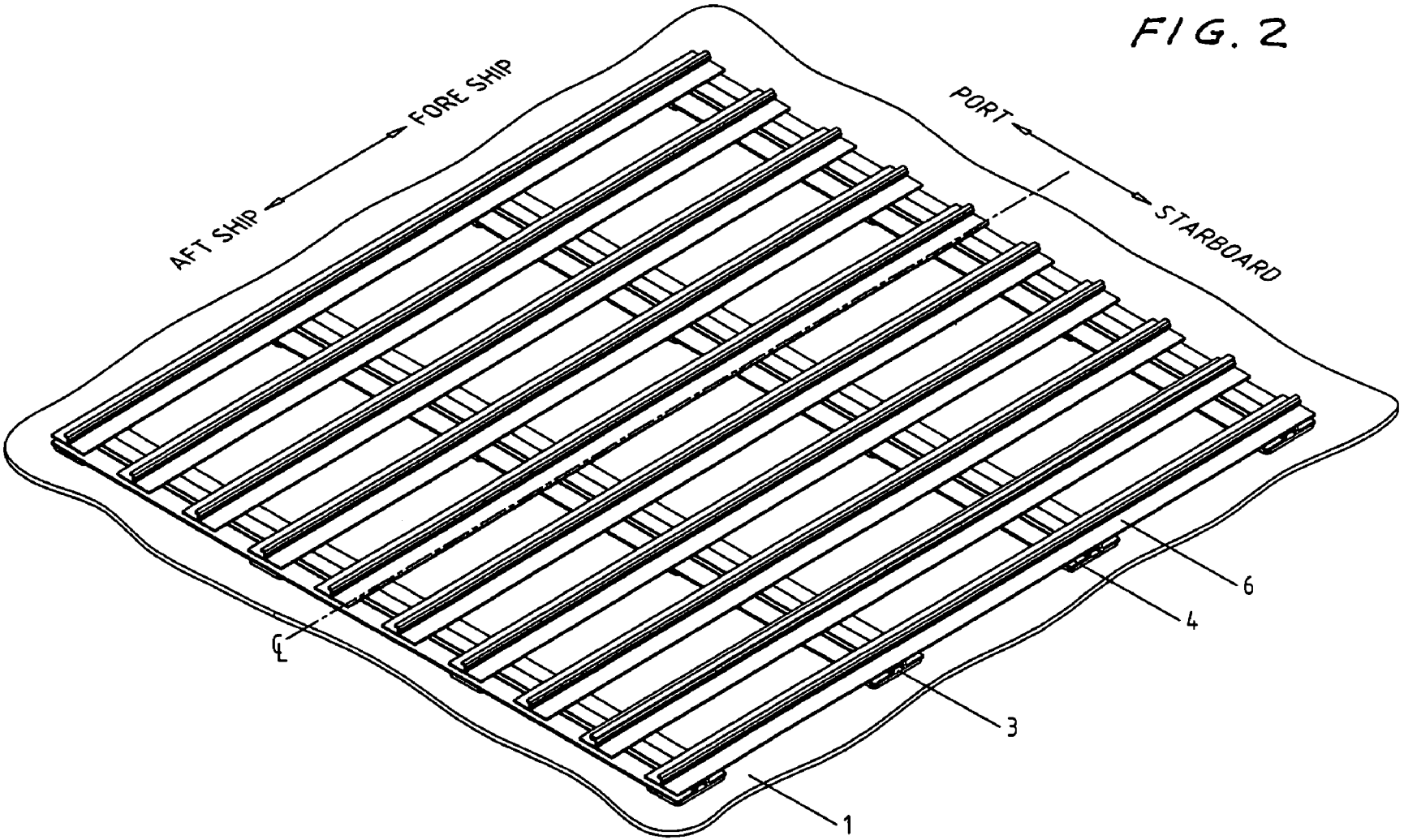
FIG. 2 is an isometric overview of the substructure.
Figure 3:
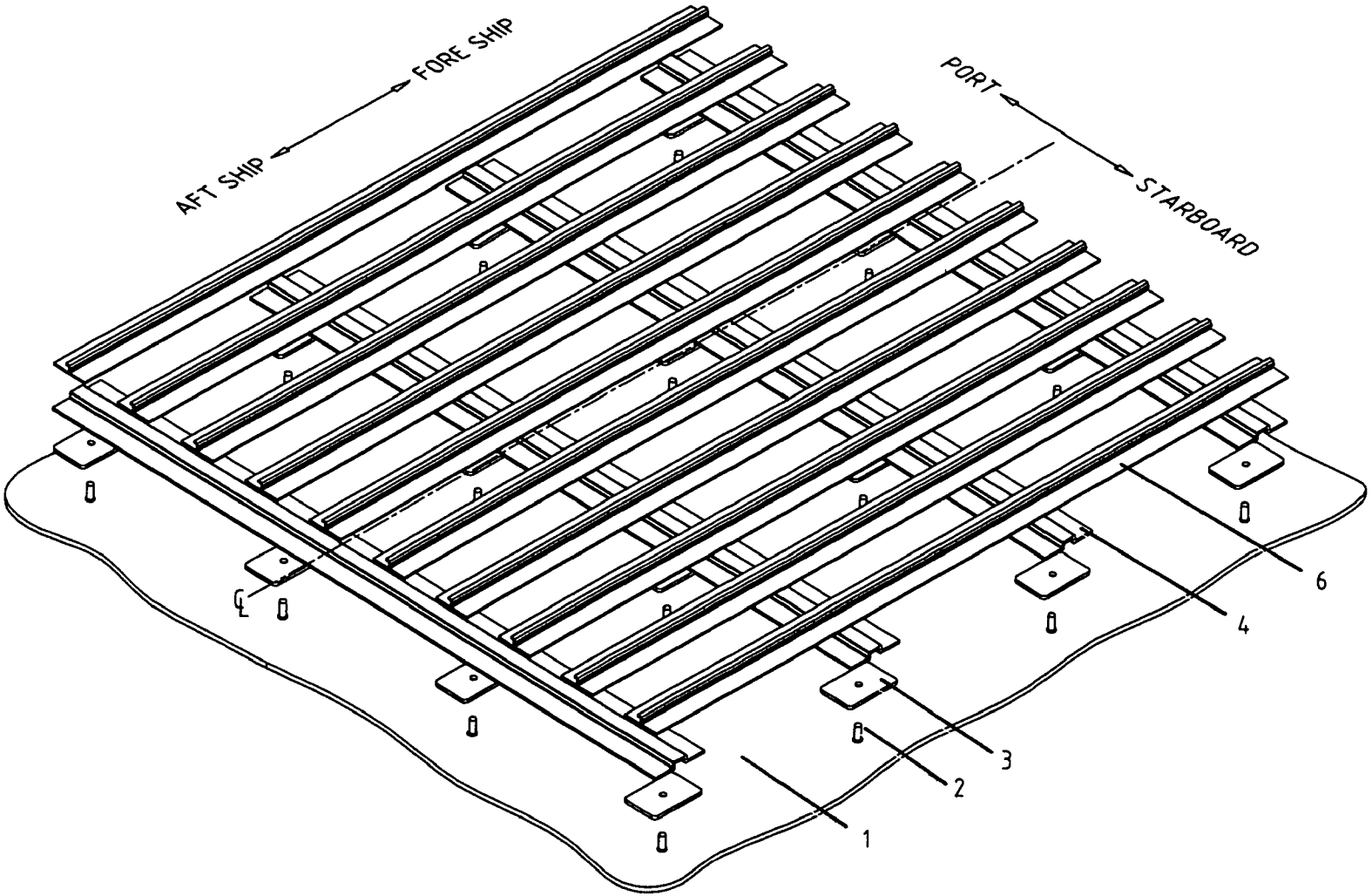

A first preferred embodiment of the present invention is a process for installing a teak deck on an as-built steel deck of a yacht. (The reader should keep in mind that other embodiments of the invention provide for installation of the teak deck on other as-built decks such as aluminum and fiberglass as-built decks.) The first preferred process can be described by reference to FIGS. 1-10. FIG. 1 shows a top view of one square meter section of a teak deck built in accordance with this first preferred embodiment. From above the deck appears to be a conventional-looking teak deck. This embodiment is based on the use of nine specially designed and pre-manufactured types of items that when assembled in a specific fashion will produce the teak deck.

Teak-Composite Battens

In a preferred embodiment, teak-composite battens units 8 are used for the surface of the deck. They are about 96 mm wide made by gluing a natural teak wood planks to a composite support to produce battens about 10 cm wide and several meters long. Two of these deck batten units 8 are shown in cross section in FIG. 10 locked in place as will be explained below. The teak wood 8.1 is preferably teak about 12 mm thick and the composite material 8.2 is reinforced plastic also about 12 mm thick. The composite support includes longitudinal grooves 50A and 50B as shown in FIG. 11A on each side to lock the batten into the specially designed batten rail fixtures 6. The composite underbody 32 provides strength and ensures stability over life with the layer of teak on top providing the wearable surface.

Support Structure

FIGS. 5 and 6 show features of a support structure that is built to support the deck. The first step in the process is to weld a threaded M8×20 stud 2 to the as-built deck 1 at specific intervals to produce a grid of studs spaced in two perpendicular directions at one-foot intervals (303 mm). The, M8×20 studs provide the attachment and support for the entire substructure of the invention. A threaded leveling plate 3 each having an 8×20 threaded hole in the middle is attached to each stud by threading. These leveling plates are threaded down onto the studs 2 to a specific height to achieve a desired camber, sheer, or slope. These heights can be determined manually by a fairing batten or with the use of a laser and mathematical formula, which adds or subtracts height of the leveling plate to correct deficiencies (highs or lows) in the as-built deck. Additional camber, sheer, or slope can be added or subtracted mathematically. Preferably the relative height of each leveling plate is determined by a computer program that calculates the position of the each plate based on an overall design of the deck. A reference height is then preferably established using the laser leveling device such as a laser-MARK™ 57-LMH available from CST Berger with offices world wide, headquartered in Watseka, Ill. The minimum height between the "as-built deck" and the leveling is approximately 5 mm to allow spot welding and easy drainage of water. Once the leveling plates have been set to the desired heights support rails 4 are set on top of the leveling plates 3 in a port to starboard fashion at one foot intervals over the entire deck. Support rails 4 are preferably about 1¼ inch wide and have a cross section shape as shown in FIG. 5 with a hump in the middle to accommodate about ¼ inch section of stud extending through leveling plate 3. In this preferred embodiment studs 2, leveling plates 3 and support rails 4 are all comprised of stainless steel. Support rails 4 are preferably extruded with the cross section shape shown in FIG. 5. The support rails 4 are attached to leveling plates 3 by spot welds as shown at 5 in FIG. 5. Upon completion of these spot welds the support for the deck is structurally complete and takes the place of conventional fairing and plywood sub-decking used in the current state of the art. Batten fixtures 6, also stainless steel and having the cross section shown in FIG. 6, must now be added to provide for the attachment of the composite-teak boards to the support base. These batten fixtures 6 are spaced in a foreword and aft direction (bow to stern) at specific intervals according to the width of the battens used. In this embodiment the battens are standard size (96 mm) battens which are the standard cruise ship width. Once the exact spacing and lines are established, the batten fixtures are structurally attached to support rails 4 via a MIG weld process. The welds are shown at 7 in FIG. 6. The deck substructure is now complete and ready for covering with the composite-teak boards described above.

Installing the Batten Units

The teak-composite battens 8 are fitted into the batten fixtures 6 in a specific method and order as described below to allow them to be locked into place by the locking splines C.

Once the teak floor has been covered the locking splines are covered with removable sections of rubber strips G. At this point the deck is trimmed using conventional methods of known art supported inboard and outboard, normally level with the installed teak battens.

Fitting the Battens into the Deck Substructure

To achieve the desired results a complete row of batten units 8 is fixed into the batten fixtures 6B as shown in movement A in FIG. 10. The rows are filled from the outboard toward the middle of the boat, yacht or ship. They are placed in an angled downward motion in which edge 36 of batten unit 8 is slipped under tab 38 of batten fixture 6B. When this step is accomplished locking spline C is not in place permitting edge 36 to come to rest against wall 40 of batten fixture 6. This allows sufficient lateral motion of batten unit 8 to permit it to fall into the slot between two parallel batten fixtures 6A and 6B as shown in FIG. 10. This sequence is shown as movement A in FIG. 10. After batten unit 8 has dropped it must be moved in the direction shown as motion B of FIG. 10, locking spline 9 is inserted as shown at C in FIG. 10. This effectively locks both side of the batten unit 8 into position as the rabbits and slots cut in composite board 8.2 to lock under the profiles engineered into the batten fixtures 6B. At this point one row of batten units 8 have been placed and one row of locking splines 9 has been set. This took 3 motions A, B, and C. These actions must now be repeated for each row of batten units. Accordingly, FIG. 10 shows movements D a repeat of movement A; movement E a repeat of movement B; and movement F a repeat of movement C. It is noted that when FIG. 10 action E is completed the locking spline 9 for that row is now locked in place. Once the actions required in movements FIG. 10 D, E, and F have been completed the second row of battens units has been installed. Now the final action of the four basic actions required FIG. 10. Action G can be performed. This is placement of the removable rubber or rubber-like material 10 (with a cross section as indicated in FIG. 10) in the narrow slots between the battens. Now it is necessary to continue the sequence until the entire surface area to be covered is complete. Once completed, the deck can be trimmed.

Drawings of Individual Components

Detailed drawings of individual components of the first preferred embodiment are FIGS. 11A through 11N.

FIGS. 11A, 11B and 11C show the preferred batten unit 8 and the two components of the unit, teak board 8.1 and composite board 8.2.

FIGS. 11D and 11E show a cross section view and a prospective view of rubber spacer 10.

FIGS. 11F and 11G show a cross section view and a prospective view of reinforced plastic locking spline 9.

FIGS. 11H and 11I show a cross section view and a prospective view of batten fixture 6.

FIGS. 11J and 11K show a cross section view and a prospective view of support rail 4.

FIGS. 11L, M and N show side, top and prospective views of leveling plate 3.

Other Embodiments

The present invention has been described above in the context of installing a teak deck on a steel as-built deck. However, the concepts of this invention can be applied in many other situations. Some of these are specifically described below:

Studs and "As Built" Decks

Appropriate modifications should be made to accommodate "as built" decks other than steel "as built" decks. For example two-material studs are available where the bottom of the stud is aluminum and the top is stainless steel. These studs are fabricated using a special and the material is referred to as "explosive bar". The bottom part of the stud therefore can be easily welded to and aluminum as built deck and the top of the stud can be easily welded to a stainless steel support structure. For fiberglass and wood "as built" decks, stainless steel studs are available with a carbon-fiber base (about one square inch) that can be easily apoxied to the wood or fiberglass deck. The stud size could be increased to handle heavier loads or thicker decks. Studs 2 could be made of aluminum and if so they should be thicker as necessary to carry all expected loads.

Leveling Plates

The preferred leveling plates 3 screw on to the studs, but an alternative would be to use metal studs without threads and a leveling plate that slides onto the stud. The leveling plate would then be welded at the proper position on each stud.

Support Rails

Instead of spot welding the support rail 4 to the leveling plate 3, it could be welded using a process called "through welding" in which a hole is burned through the top piece to the bottom piece and then the hole is filled with weld material. This weld technique may in many cases make the weld process easier since it is not necessary to attach an electrode to the bottom piece. Support rails could be made of materials such as aluminum instead of stainless steel as described for the first preferred embodiment.

Batten Fixture

Batten fixture 6 that the batten units 8 fit into could be made of metals other than stainless steel or in some cases plastic batten fixtures may be appropriate.

Composite Portion of the Batten Units

The composite portion 8.2 of the teak-composite batten units 8 may be machined from stock material instead of extruded as described in the preferred embodiment. A variety of reinforced plastics are available for the composite part. In some situations materials other than reinforced plastics may be substituted depending on factors such as state of arts and fluctuation in material cost.

Teak Portion of Batten Units

Other standard size teak boards could be used, such as 56 mm wide rather than 96 mm wide and could be 16 mm thick rather than 12 mm thick. And in some cases there may be reasons to use non-standard boards. Also different woods or non-wood surfaces could be used in the place of teak board 8.1 creating an entirely different top surface. Examples are maple, oak and Trex® deck.

Locking Spline

Locking spline 9 could be made of many different materials such as reinforced plastic, polyvinyl acetate (PVA) or polyvinyl chloride (PVC).

Rubber Spacer

Rubber spacer 10 could be any of many types of rubbery material and could be provided in roll form and cut and inserted or it could be installed in liquid form to solidify in place.

The present invention has been described in terms of specific embodiments, will recognize that the basic concepts of the present invention can be utilized effectively in many other situations. For example, the size and spacing of the various elements could be varied to achieve different desired results. Although the decks as described above were conceived especially for decks of boats, yachts and ships the decks would make a great decks for a handball courts or other shore-based facility. Other versions of the batten fixture 6 and the batten unit design could be provided to lock in the batten units. Therefore, the scope of the present invention should be determined by the appended claims and their legal equivalents.

I claim:

1. A fitted deck installed on an as-built deck comprising:

A) a plurality of threaded stud elements are stud attached to the as-built deck to form a regular grid of threaded studs, B) a plurality of leveling plates with at least one leveling plate threaded to a specific height on each of said plurality of threaded stud elements, C) a plurality of support rails with each support rail welded to a at least two of said plurality of leveling plates to provide a floor support for the deck, D) a plurality of batten fixtures with each batten fixture welded to at least two support rails to form at least a portion of a locking grid, E) a plurality of deck batten units and a plurality of locking splines fitted into said locking grid and F) a plurality of narrow rubber-like filler units inserted above said locking splines and between two of said deck batten units.

2. A fitted deck as in claim 1 wherein the heights of said leveling plates are determined at least in part using a laser level indicator and a set of height specifications determined by a computer processor to achieve for the deck a desired camber, sheer, and slope.

3. A fitted deck as in claim 1 wherein the support rails are generally aligned on a vessel defining an axis in directions generally perpendicular to the vessel axis i.e. aligned port to starboard.

4. A fitted deck as in claim 1 wherein said batten rail fixtures generally aligned fore and aft on a vessel defining an axis bow to stern parallel to the axis of the vessel and are welded to the support rails to form said locking grid.

5. A fitted deck as in claim 1 wherein said deck batten units are made by gluing natural wood boards to a composite support to produce battens several meters long.

6. A fitted deck as in claim 5 wherein said wood is teak and the composite material is reinforced plastic.

7. A fitted deck as in claim 5 wherein said deck batten units are about 10 cm wide.

8. A fitted deck as in claim 5 wherein the composite support includes longitudinal grooves on each side to lock the deck batten unit into the batten rail fixtures.

9. The fitted deck as in claim 1 wherein one or more of said locking splines is inserted between a portion of one of said batten fixtures and one of said deck batten units.

10. A method of installing a fitted deck on an as-built deck comprising:

A) attaching a plurality of threaded stud elements to the as-built deck to form a regular grid of threaded studs, B) threading a leveling plates to a specific desired height on each of said plurality of threaded stud elements, C) welding a plurality of support rails to said plurality of leveling plates to provide a floor support for the deck, D) welding a plurality of batten fixtures to support rails to form at least a portion of a locking grid, E) fitting a plurality of deck batten units and a plurality of locking splines into said locking grid and F) inserting a plurality of narrow rubber-like filler units above said locking splines and between two of said deck batten units.

11. The method as in claim 10 wherein the heights of said leveling plates are determined at least in part using a laser level indicator and a set of height specifications determined by a computer processor to achieve for the deck a desired camber, sheer, and slope.

12. The method as in claim 10 wherein the support rails are generally aligned on a vessel defining an axis in directions generally perpendicular to the vessel axis i.e. aligned port to starboard.

13. The method as in claim 10 wherein said batten rail fixtures are generally aligned fore and aft on a vessel defining an axis bow to stern parallel to the axis of the vessel and are welded to the support rails to form said locking grid.

14. The method as in claim 10 wherein said deck batten units are made by gluing natural wood boards to a composite support to produce battens several meters long.

15. The method as in claim 14 wherein said wood boards are comprised of teak and the composite support is comprised of reinforced plastic.

16. The method as in claim 10 wherein said deck batten units are about 10 cm wide.

17. The method as in claim 14 wherein composite support includes longitudinal grooves on each side to lock the deck batten unit into the batten rail fixtures.

18. The method as in claim 10 wherein one or more of said locking splines is inserted between a portion of one of said batten fixtures and one of said deck batten units.

* * * * *